US008025293B1

(12) United States Patent
Crawford et al.

(10) Patent No.: US 8,025,293 B1
(45) Date of Patent: Sep. 27, 2011

(54) AIR HOCKEY TABLE

(76) Inventors: Timothy D. Crawford, Golden, CO (US); Martin L. Brooks, Las Vegas, NV (US)

( * ) Notice: Subject to any disclaimer, the term of this patent is extended or adjusted under 35 U.S.C. 154(b) by 0 days.

(21) Appl. No.: 12/732,338

(22) Filed: Mar. 26, 2010

(51) Int. Cl.
*A63F 7/06* (2006.01)

(52) U.S. Cl. ..... 273/126 A

(58) Field of Classification Search ..... 273/126 R, 273/126 A, 108.1, 108.5, 118 R, 118 A, 119 R, 273/119 A
See application file for complete search history.

(56) References Cited

U.S. PATENT DOCUMENTS

| | | | | | |
|---|---|---|---|---|---|
| 735,995 | A * | 8/1903 | Mumford | 273/118 R |
| 2,565,238 | A * | 8/1951 | Koci | 273/126 A |
| 2,593,641 | A * | 4/1952 | Wolverton | 273/126 A |
| 3,913,918 | A * | 10/1975 | Trachtman | 273/126 R |
| 4,017,079 | A * | 4/1977 | Apellaniz | 273/126 R |
| 4,076,242 | A * | 2/1978 | Joseph | 273/108.51 |
| 4,215,863 | A * | 8/1980 | Kuiper | 273/126 R |
| 4,871,170 | A * | 10/1989 | Carini | 273/126 R |
| 4,998,729 | A * | 3/1991 | Lischerelli | 273/119 R |
| 5,368,300 | A * | 11/1994 | Becker | 273/121 R |
| 5,433,443 | A * | 7/1995 | Ples | 273/108.51 |
| 5,467,985 | A * | 11/1995 | Jones | 273/126 R |
| 5,788,231 | A * | 8/1998 | To | 273/126 R |
| 6,105,960 | A * | 8/2000 | Carames | 273/108.1 |
| 6,276,682 | B1 * | 8/2001 | Yamashita et al. | 273/126 A |
| 6,345,820 | B1 * | 2/2002 | Zucchi et al. | 273/148 R |
| 6,623,004 | B2 * | 9/2003 | Rossi et al. | 273/108.1 |
| 7,178,802 | B2 * | 2/2007 | Nally et al. | 273/108 |
| 2005/0012267 | A1 * | 1/2005 | Tien | 273/126 A |
| 2005/0161878 | A1 * | 7/2005 | Nally et al. | 273/108 |
| 2006/0082055 | A1 * | 4/2006 | Chen | 273/126 R |
| 2008/0073839 | A1 * | 3/2008 | Nally | 273/126 R |

* cited by examiner

*Primary Examiner* — Raleigh W. Chiu
(74) *Attorney, Agent, or Firm* — Klaas, Law, O'Meara & Malkin, P.C.; Robert W. Nelson, Esq.

(57) ABSTRACT

Air hockey tables are disclosed herein. An embodiment of an air hockey table comprises a playing surface bounded by at least three sides; a plurality of air paths extending through the playing surface, wherein air is emittable by the plurality of air paths, and wherein a puck is at least partially floatable on air that is emittable by the plurality of air paths; and at least one opening proximate each of three of the sides, the openings being sized to receive the puck.

18 Claims, 7 Drawing Sheets

AIR HOCKEY TABLE

BACKGROUND

Air hockey tables have four sides wherein two opposite sides have goals. Such tables are usually limited to two players. Some tables have two goals on the same side which allow for four players. However, two players have to stand very close to each other in order to play.

DETAILED DESCRIPTION

Figure 1:
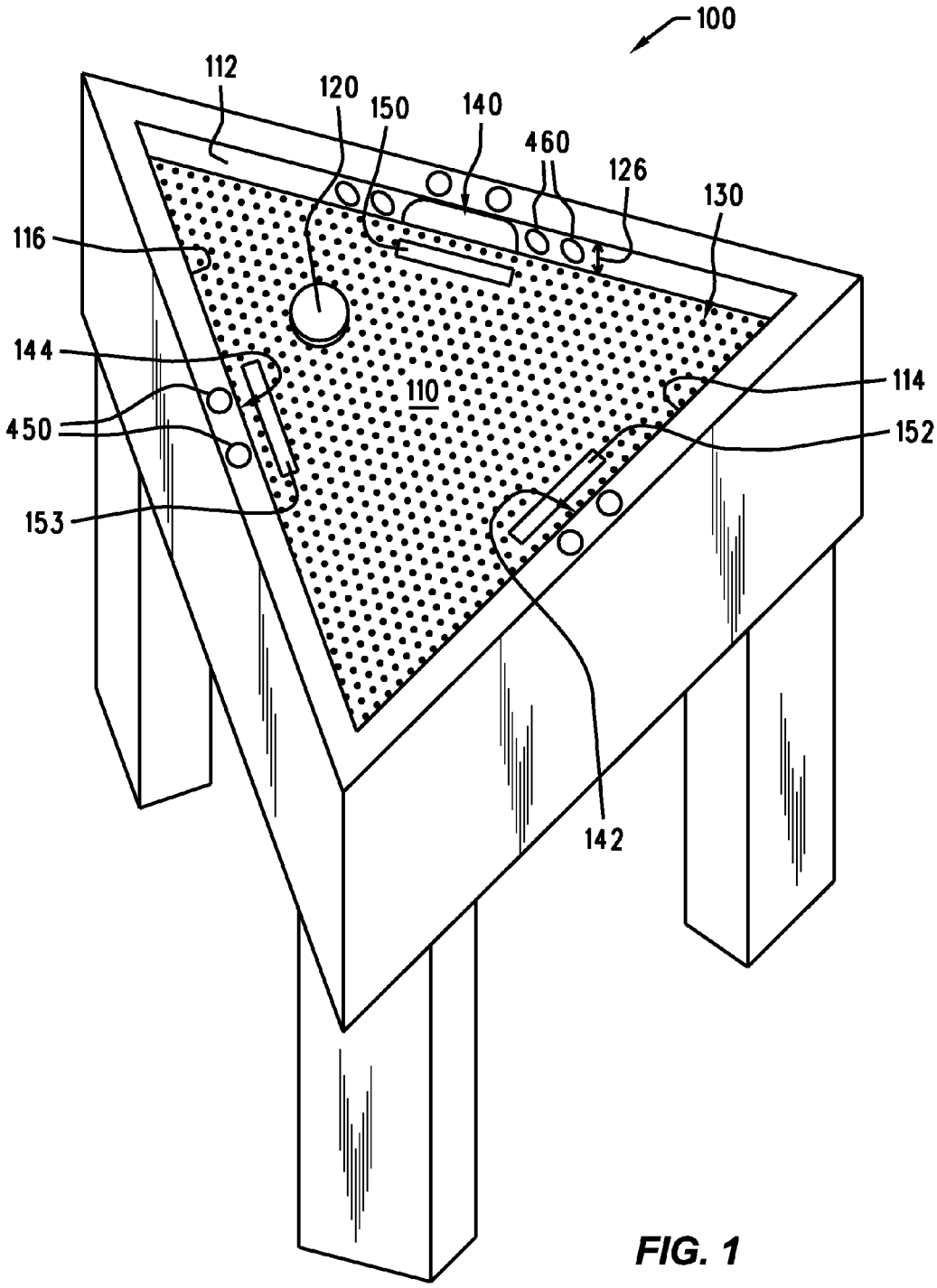
FIG. 1 is a top perspective view of an embodiment of a three sided air hockey table.

A top perspective view of an air hockey table 100 is shown in FIG. 1. The air hockey table 100 is used to play the game of air hockey wherein the objective is to place a puck in an opposing goal or to prevent the puck from entering certain goals. Unlike conventional rectangular air hockey tables, the air hockey table 100 has more than two goals or more than two sides having goals associated therewith. Accordingly, several players may play each other. The air hockey table 100 and the other air hockey tables disclosed herein offer a different type of play in that there are many different sizes and shapes of air hockey tables. It is noted that the elements of the air hockey table 100 of FIG. 1 may be out of proportion in order to accurately show the elements.

The air hockey table 100 of FIG. 1 is an embodiment of a three sided air hockey table in the shape of a triangle. More specifically, a playing surface 110 is in the shape of a triangle as defined by three sides. The sides are referred to individually as a first side 112, a second side 114, and a third side 116. The sides 112, 114, 116 may extend substantially perpendicular from the playing surface 110 a distance 126 and serve to keep a puck 120 on the playing surface 110 during play. The distance 126 is large enough to keep the puck 120 on the playing surface 110, but short enough so as not to impede play. The sides 112, 114, 116 have goals formed therein or associated with goals as described below. The term "side" as used herein refers to a side of an air hockey table that is able to accommodate or be associated with a goal. Therefore, a small corner section of an air hockey table does not constitute a side as used herein.

Figure 2:
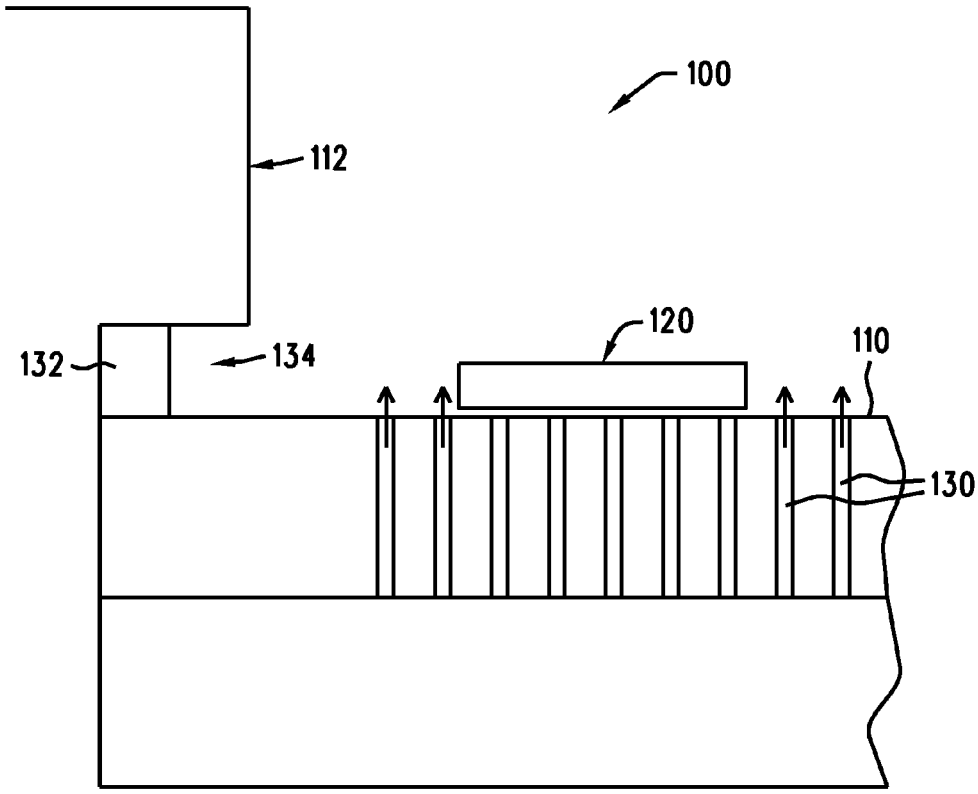
FIG. 2 is a partial, side cut away view of an embodiment of a side of the air hockey table of FIG. 1.

A side cut away view of an embodiment of the air hockey table 100 and the first side 112 is shown in FIG. 2. As shown in FIG. 2, the side 112 has a recessed portion recessed portion 134. A material 132 may be located within the recessed portion 134. The material 132 may be an elastic material, such as rubber. The material 132 may be material that is replaceable on the first side 112. Therefore, after considerable wear, the material 132, and not the entire first side 112, may be replaced. In some embodiments, there is no material 132, but there may be a recessed portion 134. In other embodiments, the recessed portion 134 may be eliminated. In other embodiments, the material 130 may protrude from the first side 112.

The playing surface 110 has a plurality of through holes 130 that are connected to an air source, such as a pressurized air source (not shown). In some embodiments, a fan or the like is used to force air under the playing surface 110 where it passes through a duct 136 and to the holes 130. The pressure created by the air passing through the holes 130 at least partially counteracts gravitational force on the puck 120 so that the puck 120 at least partially floats on the air. This is sometimes referred to as an air cushion.

At least two sides have at least one goal associated with them. In the embodiment of FIG. 1, each of the sides 112, 114, 116 has a goal associated therewith. The goals are referred to individually as the first goal 140, the second goal 142, and the third goal 144. The goals 140, 142, 144 are openings in the respective sides 112, 114, 116 of the air hockey table 100. The openings are sized to receive the puck 120. In other embodiments, the goals maybe recessed portions of the playing surface 110. In summary, the goals may be any device or portion of the air hockey table 110 that captures or otherwise stops the puck 120 when the puck 120 passes a predetermined location.

During play, players are located adjacent the sides 112, 114, 116 of the air hockey table 100. An embodiment will be described in greater detail below where two players may play on the air hockey table 100, but for this example, three players are present. Each player tries to prevent the puck 120 from entering his goal (the goal proximate the player) and tries to get the puck 120 into the goal of an opposing player. The players may use mallets or paddles commonly used in the game of air hockey to strike and/or guide the puck 120. There may be several ways to win. In one embodiment, the player with the least number of goals scored against him after a predetermined period is deemed the winner. In another embodiment, players are removed after a predetermined number of goals are scored against them. The last remaining player is deemed the winner.

Having described some of the basic embodiments of the air hockey table 100, other embodiments will now be described. In some embodiments of the air hockey table 100, barricades or the like may be moved into a position to block the puck 120 from entering a goal 140, 142, 144. For example, if only two players want to play on the air hockey table 100, the third goal may be barricaded or blocked. In other embodiments, during play, if a player has a predetermined number of goals scored against him, he may have been deemed to have lost and the barricade associated with his goal may close. In such a situation, the remaining players may play without the game being impeded by an open goal of the player that lost.

In the embodiment of FIG. 1, each of the goals 140, 142, 144 has a slot in front of it. The slots are referred to individually as the first slot 150, the second slot 152, and the third slot 154. As described with reference to FIG. 3, the barricades may be in the slots 150, 152, 154 and may be raised through the slots to deactivate their respective goals.

Figure 3:
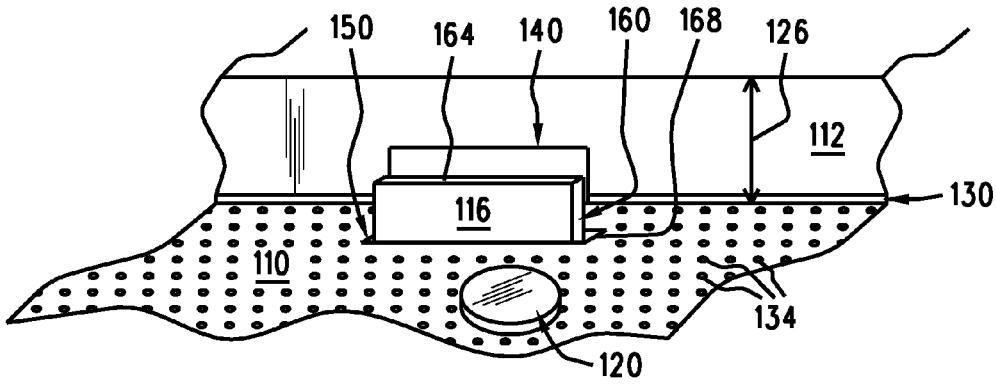
FIG. 3 is a front perspective view of an embodiment of the first goal of the air hockey table of FIG. 1 with a barricade extended.
Figure 4:
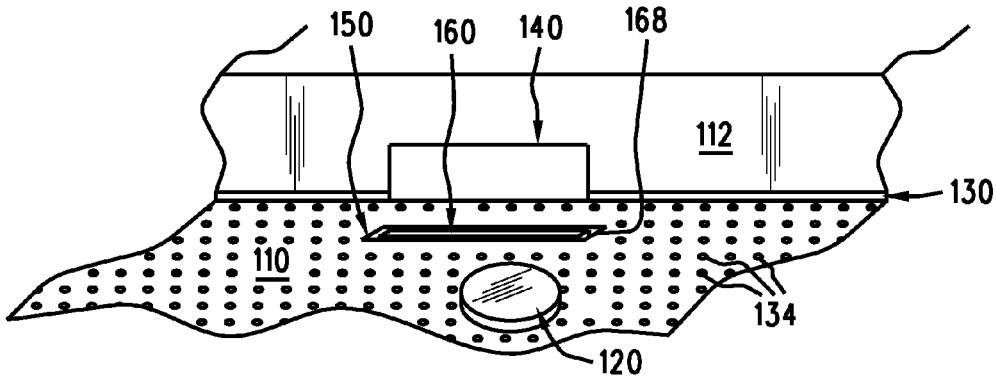
FIG. 4 is the view of FIG. 3 with the barricade recessed.

FIG. 3 is a front perspective view of the proximity of the first goal 140 with a barricade 160 in an extended position, which blocks the puck 120 from entering the first goal 140. When a barricade is in an extended position to block the puck 120 from entering a goal, the barricade is sometimes referred to as being in a first position. FIG. 4 is the same view as FIG. 3, except the barricade 160 is recessed below or even with the playing surface 110. When a barricade is in a position to enable the puck 120 to pass to the goal, the barricade is sometimes referred to as being in a second position. Although FIGS. 2 and 3 refer to the first goal 140, they are applicable any of the other goals described herein. The barricade 160 of FIG. 2 has a front face 162 and a top surface 164. The front face 162 serves to stop the puck 120 from entering the first goal 140. In many circumstances, the puck 120 will be deflected off the front face 162 of the barricade 160. In other circumstances, the puck 120 is deflected off either side of the barricade 160.

When the barricade 160 is recessed as shown in FIG. 3, the puck 120 may enter the first goal 140. In addition, the top surface 164 of the barricade 160 may be even with the playing surface 110. When the surfaces 110, 164 are even, the movement of the puck 120 over the first slot 150 is less likely to be impeded. In addition, the slot 150 may be narrow enough to as not to impede the movement of the puck 120 as the puck 120 passes over the slot 150. The slot 150 has a perimeter 168 that may be tapered downward from the playing surface 110. This taper reduces the interference that the puck 120 may encounter when it passes over the slot 150. The above-described devices for enabling the puck 120 to pass unimpeded over the slot 150 also apply to mallets or paddles used by players to strike the puck 120. Mallets and paddles may also pass over the slot 150 unimpeded.

In other embodiments, air is forced out of the slot 150. The air serves to keep the puck 120 elevated as it passes over the slot 150. More specifically, as the puck 120 passes over the slot 150, air emitted from the slot serves to elevate the puck 120 so that the puck travels unimpeded over the slot 150.

Figure 5:
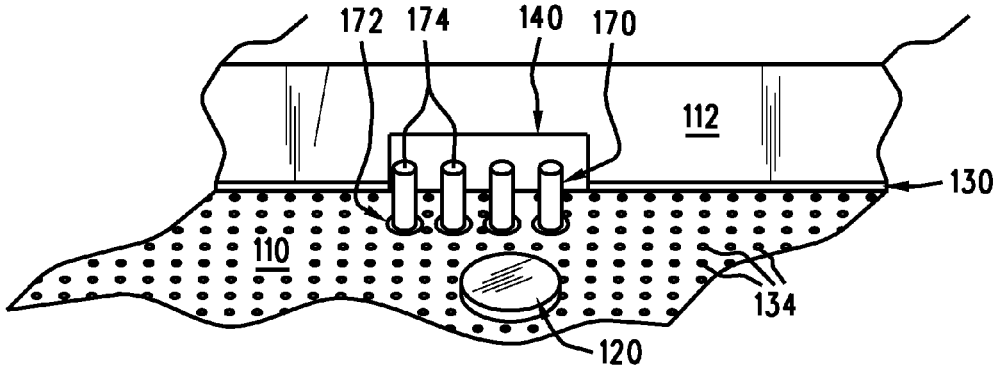
FIG. 5 is a front perspective view of another embodiment of a barricade.

Another embodiment of a barricade system is shown in FIG. 5 which discloses a plurality of pins 170 that extend through a plurality of holes 172 from the playing surface 110. The pins 170 have top surfaces 174 that may be substantially flat. When the pins 170 are extended as shown in FIG. 5, the puck 120 is prevented from entering the first goal 140. When the pins 170 are retracted into the holes 172, the flat surfaces 174 of the pins 170 may be even with the playing surface 110. Accordingly, neither the puck 120 nor mallets or paddles will interfere with the pins 170 as they travel across the holes 172.

Figure 6:
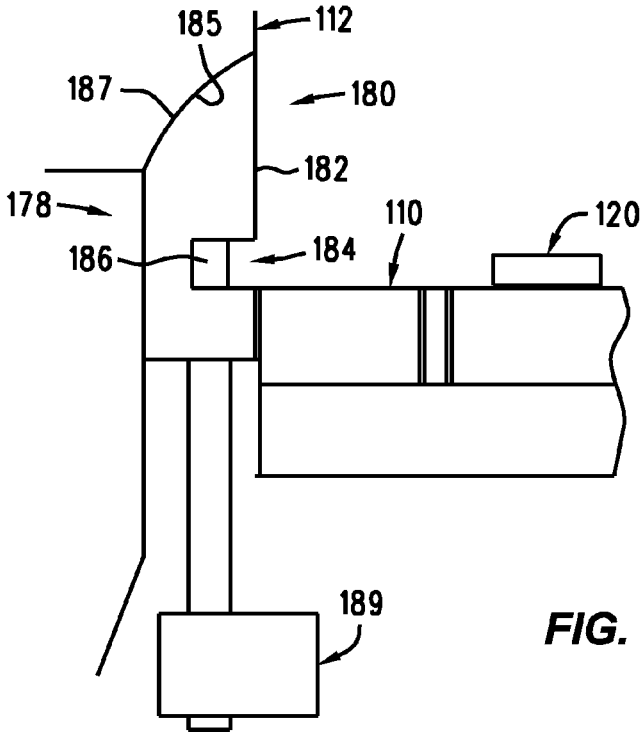
FIG. 6 is a side cut away view of a goal showing another embodiment of a barricade in a first or extended position.

Another embodiment of a barricade 180 is shown in FIG. 6, which is a side cut away view of the first goal 140. The first goal 140 and, in some embodiments, all the goals, have a puck receiver 178 that is used to hold the puck 120 after it passes through the goal. Depending on the status of the game, the puck 120 may be kept in the puck receiver 178 to end a game or returned to a player to continue game play.

The barricade 180 extends into the first side 112 and, therefore, does not interfere or modify the playing surface 110 when it is extended. The barricade 180 has a front or first surface 182 that resembles the portion of the first side 112 that intersects the playing surface 110. With additional reference to FIG. 2, the barricade 180 has a recessed portion 184 and a material 182 that are substantially similar or identical to the recessed portion 134 and material 132 of the first side 112 as described with reference to FIG. 2. Accordingly, when the barricade 180 is in the extended or first position as shown in FIG. 6, the first side 112 is substantially uniform without any, or very few, inconsistencies and the first goal 140 is blocked.

The barricade 180 has a top surface 185 that may be shaped to fit into a corresponding surface 187 within the first side. The top surface 185 as shown in FIG. 6 is curved and fits into an opposing curve in the surface 187 within the first side 112. The curved, or otherwise slanted shape, of the top surface 185 serves to maintain the barricade 180 in a fixed position relative to the first side 112 even if the barricade 180 is struck by the puck 120. Therefore, there will be little difference in the rebounding characteristics of the puck 120 between the first side 112 and the barricade 180. When the barricade 180 is in the second or retracted position that allows the puck 120 to enter the puck receiver 178, the curved top surface 185 facilitates the puck 120 entering the puck receiver 178.

Figure 7:
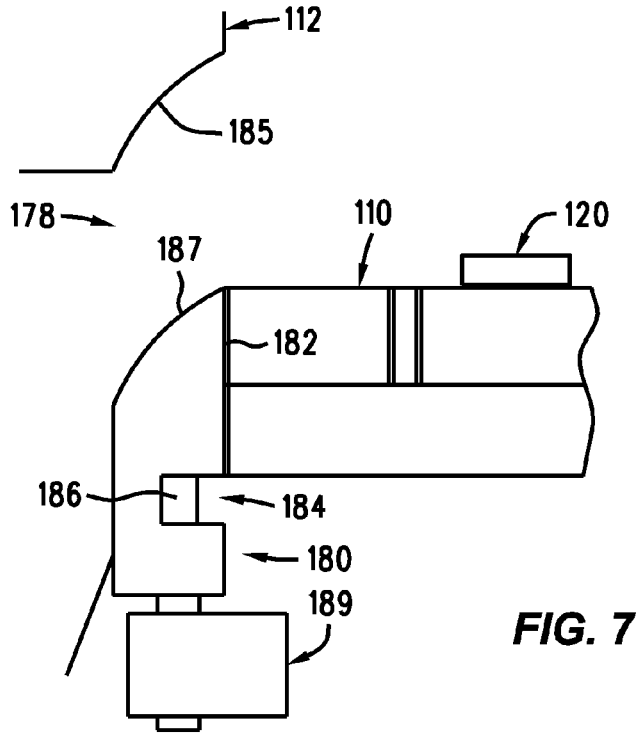
FIG. 7 is the view of FIG. 6 with the barricade in a retracted or second position.

The barricade 180 is connected to or otherwise coupled with an actuator 186 which moves the barricade 180 between the extended position shown in FIG. 6 and a retracted position shown in FIG. 7. The actuator 186 may use electromagnetism, servos, hydraulics, or other systems to move the barricade 180.

Figure 8:
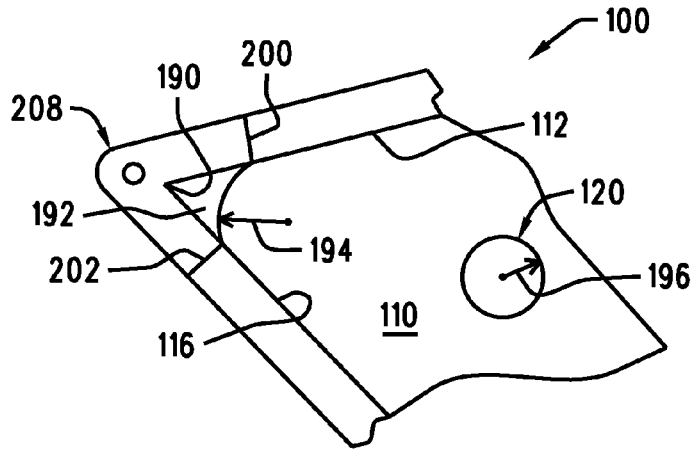
FIG. 8 is a top plan view of an embodiment of a corner of the air hockey table of FIG. 1.

Having described the barricades, embodiments of the corners of the air hockey table 100 will now be described. Reference is made to FIG. 8, which is a top plan view of the intersection of the first side 112 and the third side 116. It is noted that FIG. 8 shows the intersection of the first side 112 and the third side 116, however, the description is applicable to all sides of the air hockey table 100 and its related embodiments, such as air hockey tables described below with more than three sides. The intersections of the sides form corners that may stop the puck 120, which may temporarily stop game play. For example, the puck 120 may be wedged into the corner 190 at the intersection of the sides 112, 116 where its speed is reduced or stopped. In order to prevent the puck 120 from becoming slowed by contacting the corner 190, a corner piece 192 is placed in the corner 190. The corner piece 192 may be any piece of material that is placed in the corner 190 and that is able to withstand being struck by the puck 120. In some embodiments, the corner piece 192 has the same profile as the sides 112, 116 as shown in FIG. 6 so as to prevent any inconsistencies in the sides. In some embodiments, the corner piece 192 is concave and has a radius 194. The radius 194 is greater than the radius 196 of the puck 120. Accordingly, the puck 120 will not get stuck in the corner 190.

With regard to the corner 190, the air hockey table 100 may be manufactured in a manner where a corner section 208 is attached to two sides. In the embodiment of FIG. 8, the first side ends at a location 200 and the third side ends at a location 202. A corner section 208 that may include the corner piece 192 is attached to the sides 112, 116. During the manufacturing process, the corner section 208 may be manufactured separate from the sides 112, 116 and attached during assembly of the air hockey table 100.

The air hockey table 100 shown in the figures above has three sides, but has been described as having virtually any number of sides. For example, the air hockey tables described herein may have between four and ten sides. Air hockey tables with numerous sides will now be described.

Figure 9:
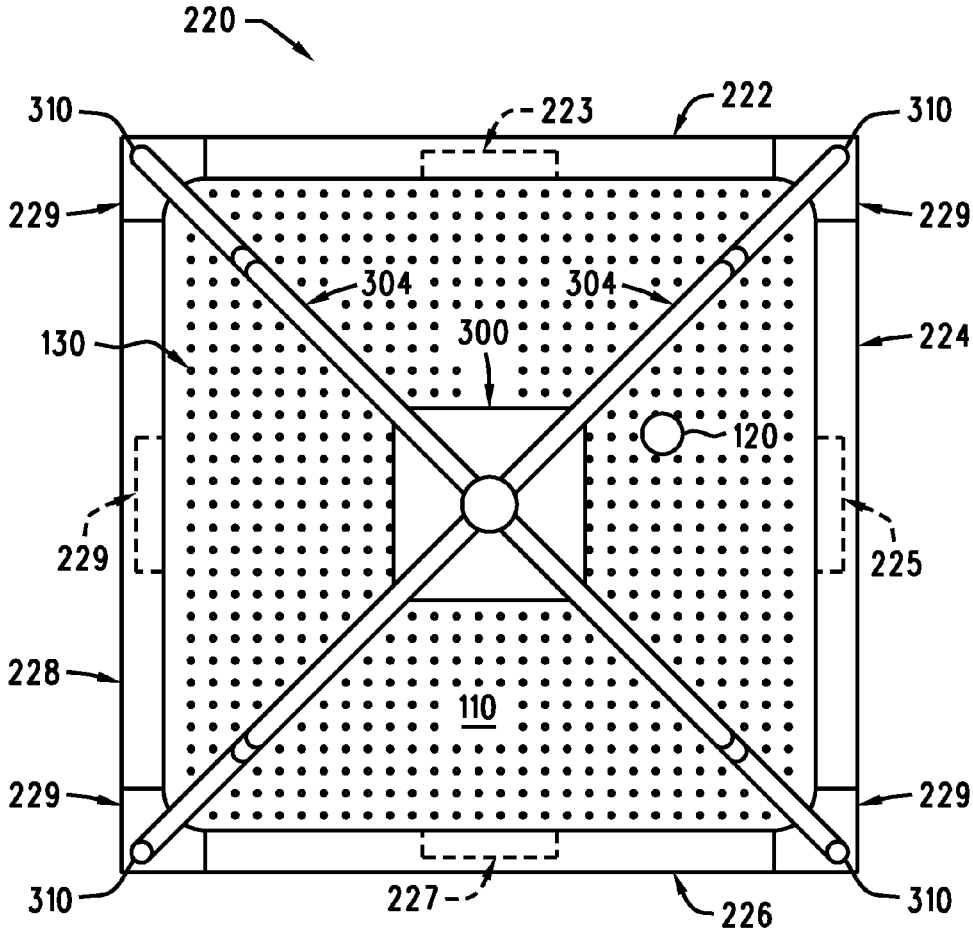
FIG. 9 is a top plan view of an embodiment of a four sided air hockey table.

A top plan view of an embodiment of four sided air hockey table 220 is shown in FIG. 9. The air hockey table 220 may be rectangular, square, or any other shape with four sides. The air hockey table 220 has a first side 222 with a first goal 223, a second side 224 with a second goal 225, a third side 226 with a third goal 227, and a fourth side 228 with a fourth goal 229. The goals 223, 225, 227, 229 may be substantially the same as the goals described above with reference to the air hockey table 100. Likewise, the sides 222, 224, 226, 228 may be substantially the same as described. The playing surface 110 may be the same as described above except for the shape. The sides 222, 224, 226, 228 may be joined by four corner portions 229. The corner portions 229 may be substantially similar to the corner portion 208, FIG. 8, except for the angle in which the sides join the corner portions.

The air hockey table 220 enables up to four players to play simultaneously. Because the goals 223, 225, 227, 229 may have barricades associated with them, fewer than four players may play because a goal will not be left open. When a player has a predetermined number of goals scored against him, the barricade associated with his goal may block the goal, so the player may not continue to play. The last remaining player may be deemed the winner. In another embodiment of a game, the players may play for a predetermined period. The player with the fewest goals scored against him at the end of the period may be deemed the winner. In yet another embodiment, the players may be on teams. For example, players on the first side 222 and the third side 226 may play players on the second side 224 and the fourth side 228. Again, the team with the fewest goals scored against it after a predetermined period may be deemed the winner.

Figure 10:
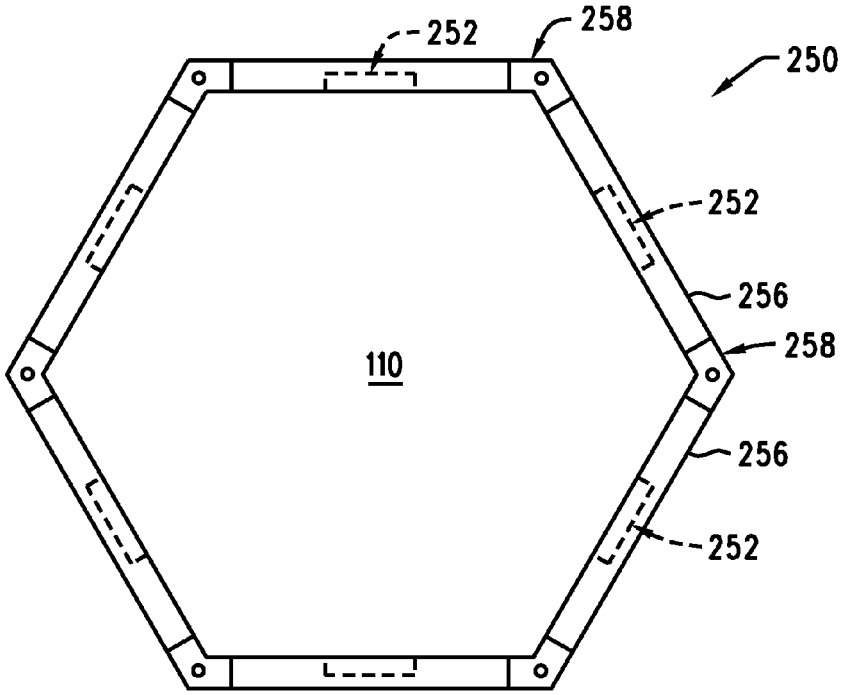
FIG. 10 is a top plan view of an embodiment of a six sided air hockey table.

A top plan view of a six sided air hockey table 250 is shown in FIG. 10. As with the other tables, the air hockey table 250 may include goals that have barricades associated with them. The air hockey table 250 has six goals 252 wherein one goal is associated with each of the six sides 256. It is noted that the air hockey table 250 need not have six goals 252. Depending on the user requirements, the air hockey table 250 may be manufactured with fewer than six goals 252. For example, the air hockey table 250 may be manufactured with three goals rather than six. Likewise, the sides do not have to have a single goal associated therewith.

The playing surface 110 of the air hockey table 250 is defined by the six sides 256, which are shown in FIG. 10 as being substantially uniform. It is noted that the sides 256 of the air hockey table 250 do not all have to be uniform in length. Varying the lengths of the sides 256 will vary the angles between the adjacent sides, which will vary the game play. The sides 256 are joined together by corner portions 258. In the embodiments wherein all the sides 256 are all the same length, the corner portions are substantially similar to each other. In such an embodiment, the air hockey table 250 may be manufactured by fabricating six substantially similar sides 256 and six substantially similar corner portions 258 and then joining them together.

Figure 11:
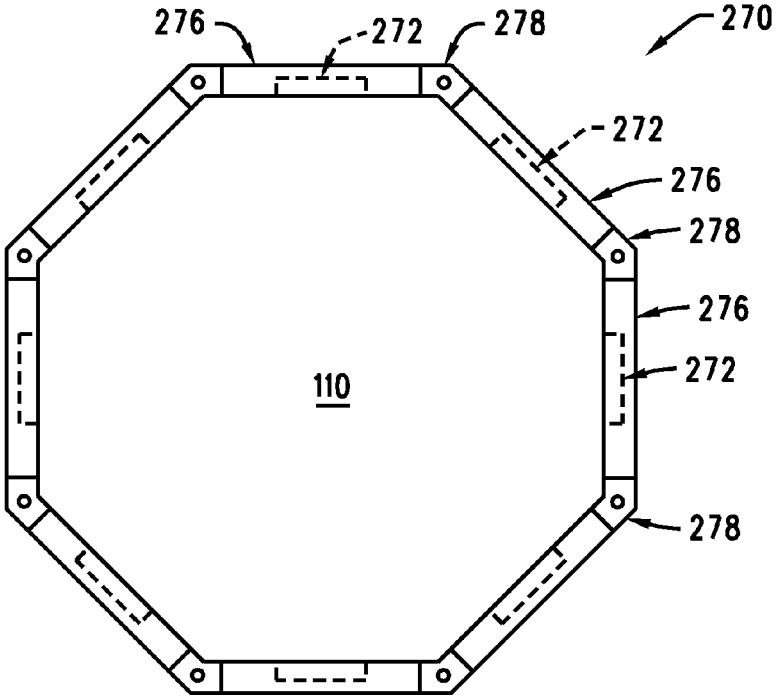
FIG. 11 is a top plan view of an embodiment of an eight sided air hockey table.

A top plan view of an eight sided air hockey table 270 is shown in FIG. 11. As with the other tables, the air hockey table 270 may include goals that have barricades associated with them. It is noted that the air hockey table 270 need not have eight goals. Depending on the user requirements, the air hockey table 270 may be manufactured with fewer than eight goals. For example, the air hockey table 270 may be manufactured with four goals rather than eight. In addition, the sides of the air hockey table 270 do not all have to be uniform in length.

Other embodiments of air hockey tables may have two goals with more than five sides. In such embodiments, goals may be associated with two sides wherein the total number of sides is five or greater. In a six sided air hockey table, the goals may be opposite each other. The sides without goals may be facing each other. The intersections of these sides may be the same or different angles.

As shown above, the air hockey tables may be made with any number of sides and goals. For example, in addition to the air hockey tables described above, air hockey tables may have five, seven, nine, or ten sides. With regard to the goals, they may be placed on any of the sides and, in some embodiments, at least one side may have more than one goal associated therewith. In some embodiments, the air hockey tables with fewer goals than sides may be configured so that the goals oppose each other. In other embodiments, the goals may be adjacent each other. For example, an eight sided air hockey table may be made with four goals all associated with adjacent sides. This configuration may also be achieved by an eight sided air hockey table with eight goals wherein only four goals are active or have their barricades in a position to allow the puck 120 to enter.

Having described embodiments of air hockey tables, methods of manufacturing air hockey tables will now be described. Reference is made to FIGS. 8, 9, 10, and 11. All the air hockey tables 100, 220, 250, 270 may be manufactured using similar components. In some embodiments, all the sides of the air hockey tables are the same size. Therefore, one size side will fit air hockey tables with three sides, four sides, five sides, and so on. The manufacturer only needs to put the correct corner portion on the air hockey table. In some embodiments, the sides may have slightly different sizes depending on the different shaped air hockey tables. However, the barricade mechanisms may be the same. In these situations, the sides only need to be cut to fit the specific air hockey table shape.

Some embodiments of the air hockey tables have scoring mechanisms associated with them. The scoring mechanisms may be in the form of a score board located above the playing surface 110 or score indications associated with each goal, wherein each goal is associated with a specific player. Referring to FIG. 4, a scoreboard 300 may be suspended above the playing surface 110 by a plurality of rods 304. The rods 304 may extend between holes 310 in the corner portions 229 and the scoreboard 300. The rods 304 may be used with all of the configurations of the air hockey tables. Although, their lengths may have to be modified slightly depending on the shape of the air hockey tables.

The scoreboard 300 may have a plurality of sides that display score. The number of sides on the scoreboard may correspond to the number of goals or sides of the air hockey table. With regard to the four sided air hockey table 220 of FIG. 9, the scoreboard has four sides, one for each player when the maximum of four players are playing. Each side of the scoreboard 300 may display the number of goals or points scored against the goal the side is facing. For example, the player at the first goal 223 can look at the scoreboard 300 and see the number of goals or points that have been scored in the first goal 223. In addition, each side may display the number of goals or points scored against other players. The scoreboard 300 may also indicate the scores of teams during team play.

The air hockey tables described above may have different numbers of players playing at any time. For example, the six sided air hockey table 250 may have four players starting the game. As the game progresses, players may be eliminated. In some embodiments, new players may join a game in progress. A computer or computer processor running a program on a computer-readable medium may control the game, including barricades, scoring, puck return, and air flow to the playing surface 110 as described below.

Figure 12:
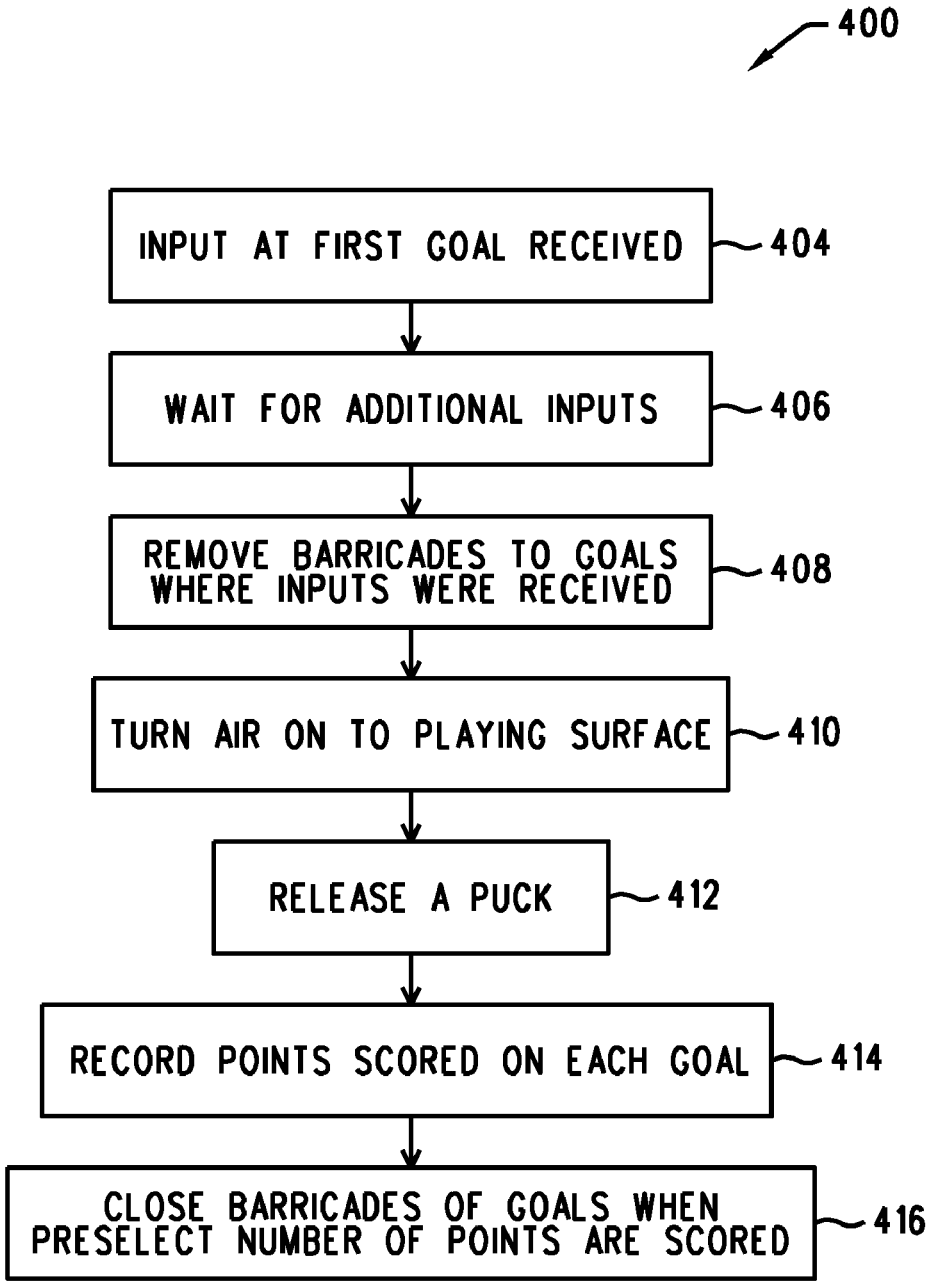
FIG. 12 is a flow chart describing an embodiment of playing air hockey on the air hockey tables.

One embodiment of playing a multiple player air hockey game is shown by the flowchart 400 of FIG. 12. The flowchart 400 is applicable to many of the air hockey tables described above. The steps described in regard to the flowchart 400 may be performed by a computer or other electronic device. In some embodiments, the steps of the flowchart 400 are performed by software running on a computer. In step 404, the air hockey table receives an input indicating that a player wants to play. The input is received at or in association with a goal. For example, the input may be in the form of money inserted into a money receiving device associated with the first goal. In other embodiments, buttons or the like may be depressed indicating that a player wants to play at the first goal.

At step 406, the air hockey table may wait a preselected period for other players to join the game. This joining may be accomplished by the players inserting more coins or providing other indications. The indications may also indicate which goal the players are to be associated with.

At this time, the number of players and their positions are established. At step 408, the barricades associated with these players are then removed or put in the second position that enables the puck 120 to pass past the barricades and into the goals. At the same time, the air may be turned on so that air passes to the playing surface 110 as described above and as shown at step 410. A puck 120 may then be released as shown in the step 412.

The game may then commence. During the game, the players may try to eliminate other players by scoring goals or points against the other players. The number of goals scored against each player may be recorded as shown at step 414. The game may be played in several different versions that are applicable to step 416. In one version, the goals are counted. When a player has a preselected number of goals scored against him, his barricade is placed into the first position, which prevents the puck 120 from entering the goal. This player has been eliminated. A light or other indicator may also provide an indication that the player has been eliminated. The game may continue until there is one player remaining, who is deemed the winner.

In another embodiment, the goals or points are counted for a specific period. The person with the least number of goals scored against him after the end of the period is deemed the winner. In yet another embodiment, teams may play. A keypad or other input device may be used to establish teams. For example, with the six sided air hockey table 250 of FIG. 10, the players may be in teams, such as three teams of two players or two teams of three players. A keyboard or the like may be used to enter team information into the air hockey table or a computer operating the air hockey table. As with the previous versions of the games, a team may be eliminated when a preselected number of goals are scored against it. Alternatively, after a preselected period, the game may end and the team with the fewest goals scored against it is deemed the winner.

In some embodiments, players may enter a game that is in play. For example, if three players are playing the six sided air hockey table 250 of FIG. 10, a fourth player may enter the game. The fourth player may provide an input to the air hockey table 250 or the computer controlling the air hockey table 250 that he wants to enter the game. In some embodiments, the fourth player puts money into a money receiver associated with a goal. The barricade associated with the goals moves to the second position to allow the puck to enter the goal. The new player may commence playing with the greatest number of points or goals of any other player. As an example, if the second player is losing with two goals, the fourth player may start the game with two goals.

The description above relates to many embodiments of air hockey tables and different methods to play air hockey. Further embodiments of air hockey tables will now be disclosed.

Referring to FIG. 1, lights 450 may be put on the sides 112, 114, 116 to indicate whether the goal or goals associated with a side are active. More specifically, the lights 450 may indicate the status of the barricade. For example, a first color light may indicate that the barricade is in the first position meaning that a player using the goal has been eliminated or has not yet entered a game. A second color light may indicate that the barricade is recessed or in the second position, which enables the player to play. This indication may inform the player of his status. For example, a player may not be able to see his goal because of his position relative to the air hockey table. The lights provide such an indication. In a similar embodiment, lights 460 may be placed on the sides 112, 114, 116 facing the playing surface 110. The lights 460 may serve the same function as the lights 450, but they may be seen better by the other players and may also illuminate the playing surface 110 proximate their respective goals.

Referring to FIGS. 6 and 7, lighting may also be used in the goals. For example, a light may be located in the puck receiver 178, which causes light to be emitted from the associated goal when the barricade 180 is recessed or in the second position. In a related embodiment, at least a part of the barricade may be translucent and two different colored light sources may be located in the puck receiver 178. The light emitted by the translucent portion of the barricade 180 indicates that the barricade is up and the player associated therewith should not be playing.

The lights 450, 460 may also be used for other purposes. For example, at the start of a game, the players need to obtain a puck 120 from a puck receiver 178. Lights 450, 460 may provide an indication as to the location of the puck. In addition, the lights 450 may indicate which player is in the lead during a game or which player is losing. At the end of a game, the lights 450, 460 may indicate which player won. The lights may also indicate when a goal has been scored and against whom.

The outer sides of the air hockey tables may contain ledges or the like that may hold beverages or other items. These ledges are on the outer sides in order to prevent the beverages or other items from being spilled or otherwise place on the playing surfaces 110. The tops of the sides may be curved or otherwise shaped to prevent people from placing items on the tops of the sides. Accordingly, by preventing items from being so placed, the items are less likely to spill or otherwise be located on the playing surfaces 110.

What is claimed is:

1. An air hockey table comprising;

a playing surface, said playing surface bounded by at least three sides, at least three of the sides having at least one opening associated therewith, wherein a puck is receivable in the openings; and a plurality of air paths extending through said playing surface, wherein air is emittable by said plurality of air paths, and wherein said puck is at least partially floatable on air that is emittable by said plurality of air paths;

at least one barricade wherein said at least one barricade is movable proximate at least one of the openings, said barricade having a first fixed position wherein said puck is prevented from entering said at least one of said openings when the puck is shot from anywhere on said playing surface and a second fixed position wherein said puck is able to enter said at least one of said openings.

2. The air hockey table of claim 1, wherein said at least three sides define a triangle.

3. The air hockey table of claim 1, wherein said at least three sides define a quadrilateral.

4. The air hockey table of claim 1, wherein said at least three sides define a polygon.

5. The air hockey table of claim 1, wherein said playing surface is bounded by at least eight sides.

6. The air hockey table of claim 1, wherein said playing surface is bounded by at least six sides.

7. The air hockey table of claim 1 wherein said at least one barricade is substantially even with the side associated with said opening when said barricade is in said first fixed position.

8. The air hockey table of claim 1, wherein said barricade comprises at least one pin.

9. The air hockey table of claim 1, wherein the boundary of said playing surface includes a radius at the intersection of at least two of said sides.

10. The air hockey table of claim 9, wherein said puck has a radius associated therewith and wherein said radius of said puck is less than said radius at the intersection of the at least two sides.

11. The air hockey table of claim 1, wherein at least one of the openings is located on said playing surface.

12. An air hockey table comprising:

a playing surface, said playing surface bounded by at least five sides, at least one opening associated with two of said sides, wherein a puck is receivable in said openings; and a plurality of air paths extending through said playing surface, wherein air is emittable by said plurality of air paths, and wherein said puck is at least partially floatable on air that is emittable by said plurality of air paths;

at least one barricade, wherein said at least one barricade is movable proximate at least one of the openings said barricade having a first fixed position wherein said puck is prevented from entering said at least one of said openings when the puck is shot from anywhere on said playing surface and a second fixed position wherein said puck is able to enter said at least one of said openings.

13. The air hockey table of claim 12, wherein said openings are associated with nonadjacent sides.

14. The air hockey table of claim 12, wherein a first side and a second side intersect to form a first angle, and wherein a third side and a fourth side intersect to form a second angle, said first angle being different than said second angle.

15. The air hockey table of claim 14, wherein said playing surface is bounded by and even number of sides and wherein said first angle is opposite said second angle relative to said playing surface.

16. A method of playing air hockey on an air hockey table, said air hockey table comprising a playing surface, said playing surface bounded by at least three sides with at least one goal located on each of said sides, barricades are located proximate said goals, wherein said goals are blockable by said barricades so as to prevent pucks from entering said goals when said puck is shot at said goal from anywhere on said playing surface, said method comprising:

opening a goal associated with each player by moving said barricade so as to enable a puck to enter said goal; and counting the number of times a puck enters each opened goal.

17. The method of claim 16 and further comprising closing goals associated with players who have a preselected number of goals scored against them.

18. The method of claim 16 and further comprising closing said goals after a preselected period.

* * * * *

UNITED STATES PATENT AND TRADEMARK OFFICE

CERTIFICATE OF CORRECTION

PATENT NO. : 8,025,293 B1
APPLICATION NO. : 12/732338
DATED : September 27, 2011
INVENTOR(S) : Timothy D. Crawford et al.

It is certified that error appears in the above-identified patent and that said Letters Patent is hereby corrected as shown below:

Column 2, Line 6 - Delete second occurrence of "recessed portion"

Column 3, Line 13 - After "applicable" insert --to--

Column 8, Line 35 - Delete "place" and insert therefore --placed--

IN THE CLAIMS

Column 10, Line 8 - Delete the first occurrence of "and" and insert therefore --an--

Signed and Sealed this
Fifth Day of February, 2013

Teresa Stanek Rea

Teresa Stanek Rea
*Acting Director of the United States Patent and Trademark Office*